US008998030B2

(12) United States Patent
Minnette et al.

(10) Patent No.: US 8,998,030 B2
(45) Date of Patent: Apr. 7, 2015

(54) PACKAGE WITH LID SEALING SYSTEM

(75) Inventors: Jeffrey C Minnette, Evansville, IN (US); Gail S. Becke, Hoffman Estates, IL (US)

(73) Assignee: Berry Plastics Corporation, Evansville, IN (US)

( * ) Notice: Subject to any disclaimer, the term of this patent is extended or adjusted under 35 U.S.C. 154(b) by 0 days.

(21) Appl. No.: 13/362,953

(22) Filed: Jan. 31, 2012

(65) Prior Publication Data

US 2012/0199599 A1 Aug. 9, 2012

Related U.S. Application Data

(60) Provisional application No. 61/440,299, filed on Feb. 7, 2011.

(51) Int. Cl.

| | |
|---|---|
| ***B65D 41/16*** | (2006.01) |
| ***B65D 41/18*** | (2006.01) |
| ***B65D 41/00*** | (2006.01) |
| ***B65D 43/02*** | (2006.01) |
| ***B65D 77/20*** | (2006.01) |

(52) U.S. Cl.

CPC .. *B65D 43/0212* (2013.01); *B65D 2543/00759* (2013.01); *B65D 2543/0024* (2013.01); *B65D 2543/00092* (2013.01); *B65D 2543/00796* (2013.01); *B65D 2543/00296* (2013.01); *B65D 2543/00537* (2013.01); *B65D 2543/00629* (2013.01); *B65D 2543/00685* (2013.01); *B65D 2543/0037* (2013.01); *B65D 77/2088* (2013.01)

(58) Field of Classification Search

CPC ..... B65D 41/00; B65D 41/16; B65D 51/12; B65D 51/20; B65D 51/18

USPC ..... 220/213, 620, 780, 359.1–359.4, 258.1, 220/258.3, 256.1, 254.1; 206/776–778; 229/125.015; 215/232; 53/476–477

See application file for complete search history.

(56) References Cited

U.S. PATENT DOCUMENTS

| | | | | |
|---|---|---|---|---|
| 2,614,727 | A | 10/1952 | Robinson | |
| 3,276,616 | A | 10/1966 | Lurie | |
| 3,834,606 | A | 9/1974 | Andersson | |
| 3,934,749 | A | 1/1976 | Andrulionis | |
| 3,938,686 | A * | 2/1976 | Milligan et al. | 215/232 |
| 3,956,550 | A | 5/1976 | Sutch | |
| 4,109,815 | A * | 8/1978 | Collins, III | 215/232 |
| 4,111,330 | A | 9/1978 | Jordan | |
| 4,141,463 | A | 2/1979 | Smith | |
| 4,171,084 | A * | 10/1979 | Smith | 229/102 |

(Continued)

FOREIGN PATENT DOCUMENTS

| | | |
|---|---|---|
| EP | 0 536 137 B1 | 4/1993 |
| EP | 1930253 | 2/2011 |
| FR | 2827841 | 1/2003 |

OTHER PUBLICATIONS

International Search Report dated Jun. 20, 2012 for PCT/US2012/28010, 10 pages.

(Continued)

*Primary Examiner* — Anthony Stashick
*Assistant Examiner* — Jennifer N Zettl
(74) *Attorney, Agent, or Firm* — Barnes & Thornburg LLP

(57) ABSTRACT

A package includes a container and a lid adapted to mate with a brim of the container. The lid closes a top opening in the container when mounted on the container.

15 Claims, 6 Drawing Sheets

(56) References Cited

U.S. PATENT DOCUMENTS

| | | | | |
|---|---|---|---|---|
| 4,192,434 | A * | 3/1980 | Conroy | 229/125.13 |
| 4,209,107 | A | 6/1980 | Crisci | |
| 4,215,797 | A | 8/1980 | Chen | |
| 4,238,047 | A | 12/1980 | Helms et al. | |
| 4,252,248 | A | 2/1981 | Obrist et al. | |
| 4,258,529 | A | 3/1981 | Smith | |
| 4,397,133 | A | 8/1983 | Hume | |
| 4,418,834 | A * | 12/1983 | Helms et al. | 220/359.3 |
| 4,438,864 | A | 3/1984 | Helms | |
| 4,442,971 | A * | 4/1984 | Helms | 229/123.1 |
| 4,448,345 | A * | 5/1984 | Helms | 229/123.1 |
| 4,495,749 | A | 1/1985 | Faller | |
| 4,533,063 | A | 8/1985 | Buchner | |
| 4,595,117 | A | 6/1986 | Walter | |
| 4,685,273 | A | 8/1987 | Caner | |
| 4,692,132 | A | 9/1987 | Ikushima | |
| 4,838,008 | A | 6/1989 | Hardy | |
| 5,091,231 | A | 2/1992 | Parkinson | |
| 5,178,297 | A | 1/1993 | Harold | |
| 5,246,134 | A | 9/1993 | Roth et al. | |
| 5,248,134 | A * | 9/1993 | Ferguson et al. | 267/220 |
| 5,258,191 | A | 11/1993 | Hayes | |
| 5,395,005 | A | 3/1995 | Yoshida | |
| 5,511,679 | A * | 4/1996 | Beck | 220/270 |
| 5,634,567 | A * | 6/1997 | Hekal | 220/359.3 |
| 5,647,501 | A | 7/1997 | Helms | |
| 5,692,635 | A | 12/1997 | Farrell | |
| 5,810,197 | A | 9/1998 | Mazzarolo | |
| 5,911,334 | A | 6/1999 | Helms | |
| 5,947,278 | A | 9/1999 | Sawhney | |
| 5,950,861 | A | 9/1999 | Roth et al. | |
| 5,983,607 | A | 11/1999 | Mihalov | |
| 6,053,353 | A | 4/2000 | Helms | |
| 6,145,689 | A | 11/2000 | Kobayashi | |
| 6,196,451 | B1 | 3/2001 | Helms | |
| 6,234,386 | B1 * | 5/2001 | Drummond et al. | 229/123.2 |
| 6,439,387 | B1 | 8/2002 | Bergman | |
| 6,508,375 | B1 * | 1/2003 | Krall | 220/359.1 |
| 6,523,713 | B1 * | 2/2003 | Helms | 220/831 |
| 6,637,176 | B1 | 10/2003 | Krall | |
| 6,673,303 | B2 | 1/2004 | White et al. | |
| 6,749,066 | B2 | 6/2004 | Bergman | |
| 6,772,901 | B2 | 8/2004 | Witt | |
| 6,799,692 | B2 * | 10/2004 | Teixeira Alvares et al. | 220/254.1 |
| 6,857,561 | B2 | 2/2005 | Williams | |
| 6,881,286 | B2 * | 4/2005 | Drummond et al. | 156/69 |
| 7,055,713 | B2 * | 6/2006 | Rea et al. | 220/276 |
| 7,086,545 | B2 | 8/2006 | Mannion et al. | |
| 7,267,243 | B2 | 9/2007 | Steg | |
| 7,311,218 | B2 * | 12/2007 | Varadarajan | 220/257.1 |
| 7,584,866 | B2 * | 9/2009 | Selina et al. | 220/698 |
| 7,694,837 | B2 | 4/2010 | Robertson et al. | |
| 7,703,626 | B2 | 4/2010 | Witt | |
| 7,757,879 | B2 | 7/2010 | Schuetz | |
| 7,870,967 | B2 * | 1/2011 | Sawyer | 215/225 |
| 7,938,293 | B2 * | 5/2011 | Gidumal | 220/796 |
| 7,968,033 | B2 | 6/2011 | Mazzarolo | |
| 8,245,873 | B2 | 8/2012 | Steg | |
| 8,251,239 | B2 | 8/2012 | Yeung | |
| 2003/0010787 | A1 * | 1/2003 | Dalton et al. | 220/912 |
| 2003/0183636 | A1 | 10/2003 | Shih | |
| 2004/0159080 | A1 | 8/2004 | Stewart | |
| 2005/0145632 | A1 * | 7/2005 | Cocca et al. | 220/495.01 |
| 2006/0278603 | A1 * | 12/2006 | Takashima et al. | 215/349 |
| 2007/0108216 | A1 | 5/2007 | Kurth et al. | |
| 2007/0187352 | A1 * | 8/2007 | Kras et al. | 215/276 |
| 2008/0110896 | A1 | 5/2008 | Westphal | |
| 2008/0264961 | A1 * | 10/2008 | Sawyer | 220/810 |
| 2009/0032534 | A1 | 2/2009 | Luburic | |
| 2009/0032535 | A1 | 2/2009 | Dunwoody et al. | |
| 2009/0302040 | A1 * | 12/2009 | Fox et al. | 220/359.2 |
| 2010/0059537 | A1 | 3/2010 | Stevens | |
| 2010/0096388 | A1 | 4/2010 | Kobayashi et al. | |
| 2010/0140282 | A1 | 6/2010 | Steg | |
| 2011/0100990 | A1 | 5/2011 | Clodfelter et al. | |
| 2012/0199599 | A1 | 8/2012 | Minnette | |
| 2012/0205375 | A1 | 8/2012 | Hudson | |
| 2012/0234835 | A1 | 9/2012 | Minnette | |
| 2012/0270167 | A1 * | 10/2012 | Sato et al. | 432/13 |
| 2012/0305560 | A1 | 12/2012 | Minnette | |
| 2013/0008904 | A1 | 1/2013 | Minnette | |
| 2013/0032598 | A1 * | 2/2013 | Triquet et al. | 220/359.2 |
| 2013/0047559 | A1 | 2/2013 | Minnette | |
| 2013/0104505 | A1 | 5/2013 | Minnette | |
| 2013/0112690 | A1 * | 5/2013 | Jongsma et al. | 220/359.2 |
| 2013/0270143 | A1 | 10/2013 | Muscato | |

OTHER PUBLICATIONS

International Search Report for PCT/US2012/023639.

International Search Report and Written Opinion dated Apr. 14, 2014, relating to International Application No. PCT/US2013/070273.

International Search Report dated Jun. 20, 2012, relating to International Application No. PCT/US2012/28010.

International Search Report dated May 11, 2012, relating to International Application No. PCT/US2012/023639.

International Search Report dated Sep. 28, 2012, relating to International Application No. PCT/US2012/045965.

European Search Report for Appl. No. 12745363.7 dated Jun. 20, 2014.

Office Action dated Jun. 9, 2014 for U.S. Appl. No. 13/544,753.

International Search Report and Written Opinion dated Sep. 4, 2014, relating to International Application No. PCT/US2014/035837.

* cited by examiner

PACKAGE WITH LID SEALING SYSTEM

PRIORITY CLAIM

This application claims priority under 35 U.S.C. §119(e) to U.S. Provisional Application Ser. No. 61,440,299, filed Feb. 7, 2011, which is expressly incorporated by reference herein.

BACKGROUND

The present disclosure relates to a package, and particularly to a package including a container and a system for sealing a closure for the container. More particularly, the present disclosure relates to a closure provided with a sealing material and the composition of that sealing material.

SUMMARY

A package in accordance with the present disclosure includes a lid adapted to mate with a brim of a container to close an opening into an interior product-storage region formed in the container. In illustrative embodiments, the package is configured to store food in the product-storage region formed in the container.

In illustrative embodiments, the lid comprises a membrane sheet and a sheet-support ring coupled permanently to the entire perimeter edge of the membrane sheet. The sheet-support ring is configured to mate temporarily with the brim of the container in any suitable way to retain the membrane sheet in mating and sealing engagement with the container brim so that the opening into the product-storage region formed in the container is closed while the lid remains in place on the container.

In illustrative embodiments, the membrane sheet closes a central opening framed in the sheet-support ring to provide a lid. The membrane sheet also mates directly in sealed relation to the container brim to establish a fluid seal between the lid and the container brim without having to rely on a separate seal placed between the lid and the container brim.

In illustrative embodiments, the membrane sheet is a multi-layer film comprising an outer bed arranged to mate permanently with the sheet-support ring, an inner bed arranged to mate temporarily with the brim of the container and separate from the brim when the lid is removed from the container, and a core interposed between and coupled to the outer and inner beds. The inner bed is made of a sealing material that mates with the container brim to establish a fluid seal therebetween.

The lid is reclosable in illustrative embodiments. The sealant layer included in the inner bed can be separated (as by peeling) from the container brim to break the seal therebetween during lid removal. The sealant layer included in the inner bed of the multi-layer film can be mated multiple times with the container brim to re-establish the seal therebetween during lid reclosure.

In an illustrative embodiment, the core comprises a polypropylene layer and the outer bed comprises an aggressive (i.e., non-peelable) sealant layer that is arranged to mate permanently with the sheet-support ring to anchor the membrane sheet to the sheet-support ring to form the lid. It is within the scope of the present disclosure to use any suitable means to bond the outer bed and the core to one another and retain the outer bed and core in mated relation to the sheet-support ring. It is also within the scope of the present disclosure to use any suitable means to bond the peelable sealant layer of the inner bed to the core.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 12 is a perspective view of a package in accordance with the present disclosure and showing that the package includes a container and a lid mounted on the container and made of a multi-layer membrane sheet and a surrounding sheet-support ring;

FIG. 13 is a sectional view taken along line 13-13 of FIG. 12 showing mating engagement of the lid on the brim of the container so that a perimeter portion of the multi-layer membrane sheet is trapped between an inner perimeter surface of the sheet-support ring and an outer perimeter surface of the container brim to retain product stored in the product-storage region of the container in a sealed chamber when the lid is mounted on the container; and FIG. 14 is an enlarged partial sectional view taken from a circled region of FIG. 13 showing the perimeter portion of the multi-layer membrane sheet seated in an annular interior channel formed in a side wall of the sheet-support ring and arranged to terminate at a perimeter edge formed in an annular lid-retention lug that is coupled to the side wall of the sheet-support ring and arranged to extend inwardly into an outwardly opening undercut space defined by the container brim to engage a downwardly facing surface of the container brim to retain the perimeter portion of the membrane sheet in a stationary position in sealing engagement with the container brim

DETAILED DESCRIPTION

Figure 1:
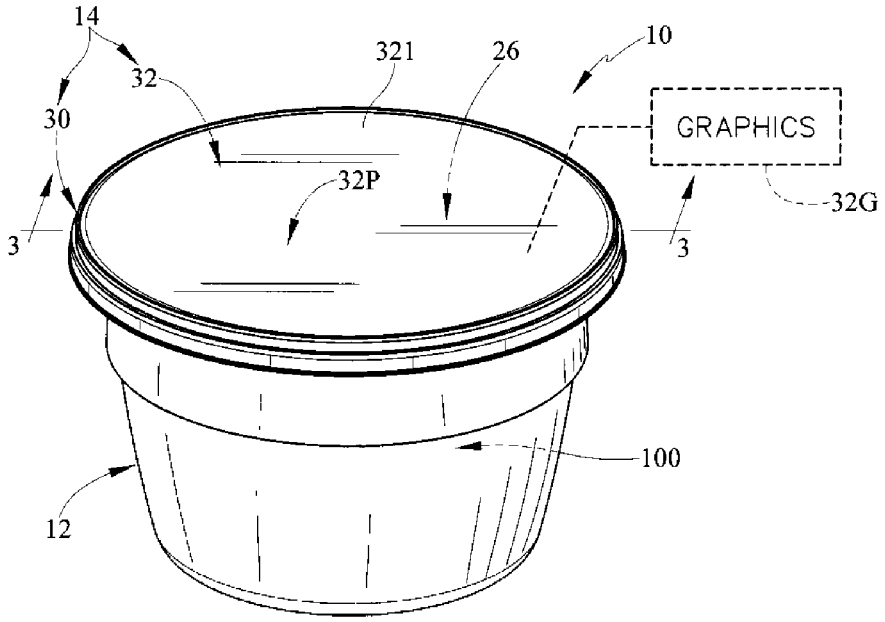
FIG. 1 is a perspective view of a package in accordance with the present disclosure and showing that the package includes a container and a lid mounted on the container and made of a multi-layer membrane sheet and a surrounding sheet-support ring as suggested in FIGS. 5-7.

A package 10 in accordance with the present disclosure includes a container 12 and a lid 14 configured to mate with container 12 to close an opening 27 into an interior product-storage region 26 formed in container 12 as suggested in FIGS. 1-4. Lid 14 comprises a sheet-support ring 30 configured to mate with a brim 24 of container 12 as suggested in FIGS. 2-4 and a membrane sheet 32 coupled permanently to the sheet-support ring 30 to move therewith whenever lid 14 is moved relative to container brim 24.

In illustrative embodiments, membrane sheet 32 provides a barrier lidstock and is anchored to the surrounding sheet-support ring 30 to form lid 14. It is within the scope of this disclosure to use insert-molding techniques to overmold sheet-support ring 30 onto the multi-layer membrane sheet 32 to form lid 14. In illustrative embodiments, membrane sheet 32 is bonded permanently to sheet-support ring 30.

Sheet-support ring 30 provides a lid-ring frame for the multi-layer membrane sheet 32. In an illustrative embodiment, sheet-support ring 30 is configured to mate temporarily in snapping relation with a portion of container brim 24 overlying an outwardly extending undercut space formed in container 12 so that container lid 14 is removable and reclosable.

Figure 4:
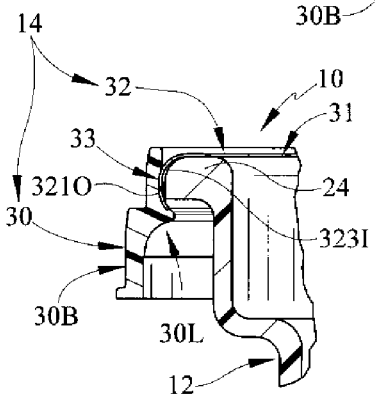
FIG. 4 is an enlarged partial sectional view taken from a circled region of FIG. 3 showing the perimeter portion of the multi-layer membrane sheet seated in an annular interior channel formed in a side wall of the sheet-support ring and arranged to terminate at a perimeter edge formed in an annular lid-retention lug that is coupled to the side wall of the sheet-support ring and arranged to extend inwardly into an outwardly opening undercut space defined by the container brim to engage a downwardly facing surface of the container brim to retain the perimeter portion of the membrane sheet in a stationary position in sealing engagement with the container brim.
Figure 3:
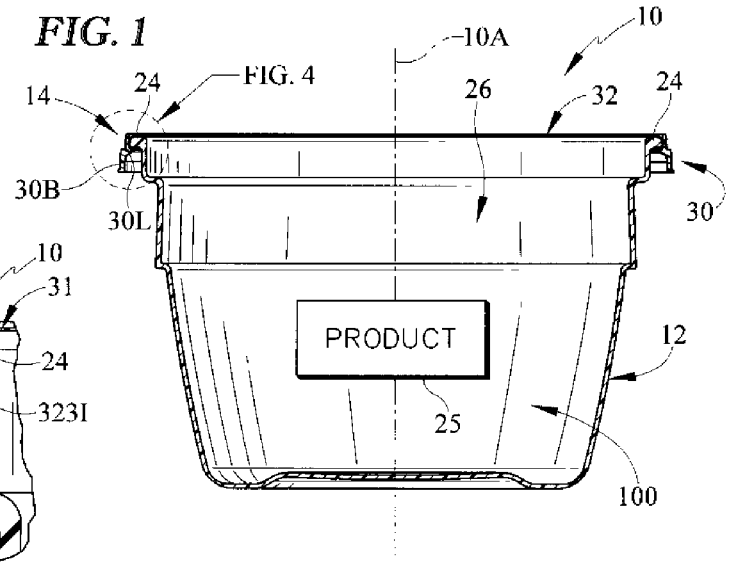
FIG. 3 is a sectional view taken along line 3-3 of FIG. 1 showing mating engagement of the lid on the brim of the container so that a perimeter portion of the multi-layer membrane sheet is trapped between an inner perimeter surface of the sheet-support ring and an outer perimeter surface of the container brim to retain product stored in the product-storage region of the container in a sealed chamber when the lid is mounted on the container.
Figure 2:
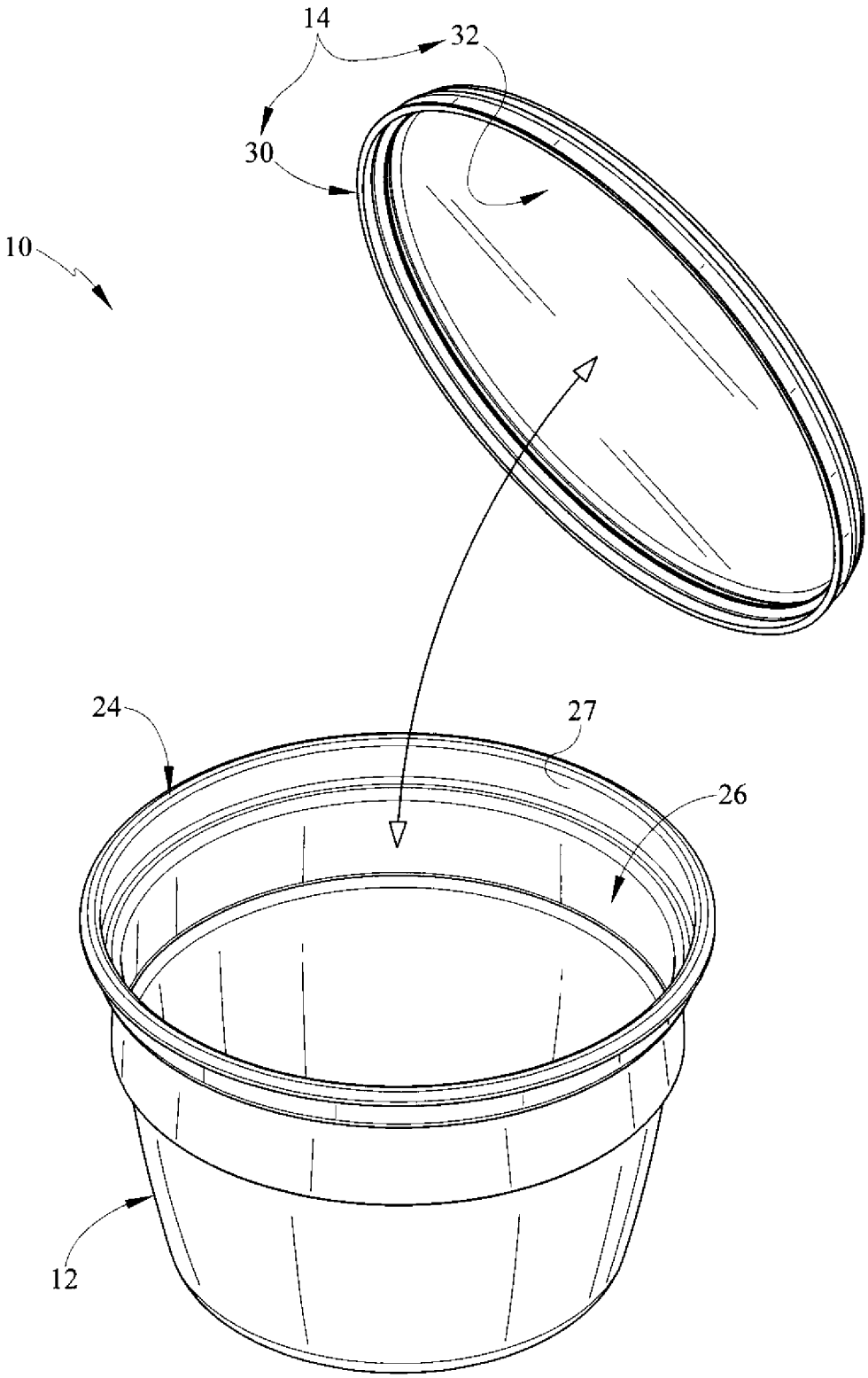
FIG. 2 is an enlarged perspective view of the container of FIG. 1 before the lid is mated with a brim included in the container to close an opening into a product-storage region formed in the container.

A multi-layer membrane sheet 32 comprises an outer bed 321 adapted to carry and exhibit high-quality high-resolution graphics 32G (as suggested in FIG. 1) and to mate with sheet-support ring 30 as suggested in FIGS. 3 and 4. Membrane sheet 32 also includes an inner bed 323 adapted to mate with container brim 24 to establish a fluid seal therebetween each time lid 14 is mounted on container 12 as suggested in FIGS. 1-4, 9, and 10. Multi-layer membrane sheet 32 also includes a core 322 interposed between and coupled to outer and inner beds 321, 323 as suggested in FIG. 6.

Inner bed 323 comprises a peelable sealant layer that in illustrative embodiments is configured to engage container brim 24 to establish a sealed connection between lid 14 and container 12 when the reclosable lid 14 is mated with container brim 24 so that ingress of oxygen and other contaminants into product-storage region 26 formed in container 12 is blocked while lid 14 is mated to container 12. Lid 14 can be removed from container 12 and reclosed in one piece repeatedly by a consumer to close opening 27 into interior product-storage region 26 formed in container 12 each time lid 14 is mated to container 12.

In a container-filling process in accordance with the present disclosure, a product 25 (e.g., food) is deposited into interior product-storage region 26 formed in container 12. Then lid 14 is mounted on container 12 to close an opening 27 into product-storage region 26 as suggested in FIG. 2 and to cause the peelable sealant layer established by inner bed 323 in membrane sheet 32 to mate with brim 24 of container 12 as suggested in FIGS. 1, 3, 4, 9, and 11. Then, for example, the peelable sealant layer established by inner bed 323 is welded to container brim 24 using heat applied to inner bed 323 through outer bed 321 and core 322 or other suitable means. It is within the scope of the present disclosure to couple inner bed 323 of membrane sheet 32 to container brim 24 through heat applied by conduction or transmission of ultrasonic or electromagnetic energy.

In illustrative embodiments, sheet-support ring 30 has an endless (e.g., round, ring-shaped, square, oblong, etc.) edge shaped to mate with a companion container 12. Sheet-support ring 30 may be thermoformed or otherwise molded of a suitable plastics material. Suitable materials include polypropylene (PP) or high-density polyethylene (HDPE). Sheet-support ring 30 may also be made of polyethylene terephthalate (PET) or crystallized polyethylene terephthalate (CPET) to improve barrier properties. Sheet-support ring 30 may also be made using a coextruded material with barrier polymers such as EVOH or PVdC in a center layer.

In illustrative embodiments, multi-layer membrane sheet 32 can be produced using a coextruded film or sheet product comprising, for example, PP or HDPE. Membrane sheet 32 may also include one or more barrier layers such as EVOH, NYLON, or PVdC, tie layers, and a sealant layer. The sealant layer may comprise metalized LDPE or LLDPE, PP-based sealant, blends of PP and polybutene, as well as EMA- and EVA-based sealants.

It is unnecessary to attach a separate closure film or foil to the container on the filling line after container 12 has been filled and before lid 14 is mounted on container 12 when using a lid 14 in accordance with the present disclosure owing, in part, to the provision of a peelable sealant layer 323 in the lid 14 disclosed herein. Packaging cost and complexity is thus minimized and the customer is provided with an easy-to-use product that is characterized by sustainability.

A package in accordance with the present disclosure is well-suited for use in hot-filled non barrier containers. It may also be used in barrier, retortable containers. Sustainability is enhanced because the lid is made of like materials without the inclusion of metal rings or other non-plastics materials in illustrative embodiments.

A package 10 in accordance with the present disclosure includes a container 12 and a lid 14 as suggested in FIGS. 1-4. Container 12 is formed to include a product-storage region 26 and a brim 24 bordering an opening 27 into product-storage region 26. Lid 14 is adapted to mate with brim 24 of container 12 to close the opening 27 into product-storage region 26 formed in container 12 as suggested in FIG. 3.

Lid 14 includes a sheet-support ring 30 and a membrane sheet 32 as suggested in FIGS. 4-7. Membrane sheet 32 is coupled permanently to sheet-support ring 30 to move therewith relative to container 12 as suggested in FIG. 2.

Sheet-support ring 30 is configured to mate with brim 24 of container 12 when lid 14 is mounted on container 12 to extend around the opening 27 into product-storage region 26 as suggested in FIGS. 1-4. Sheet-support ring 30 also is configured to include an inwardly facing wall 34W arranged to face toward brim 24 of container 12 as suggested in FIGS. 7-9.

Figure 8:
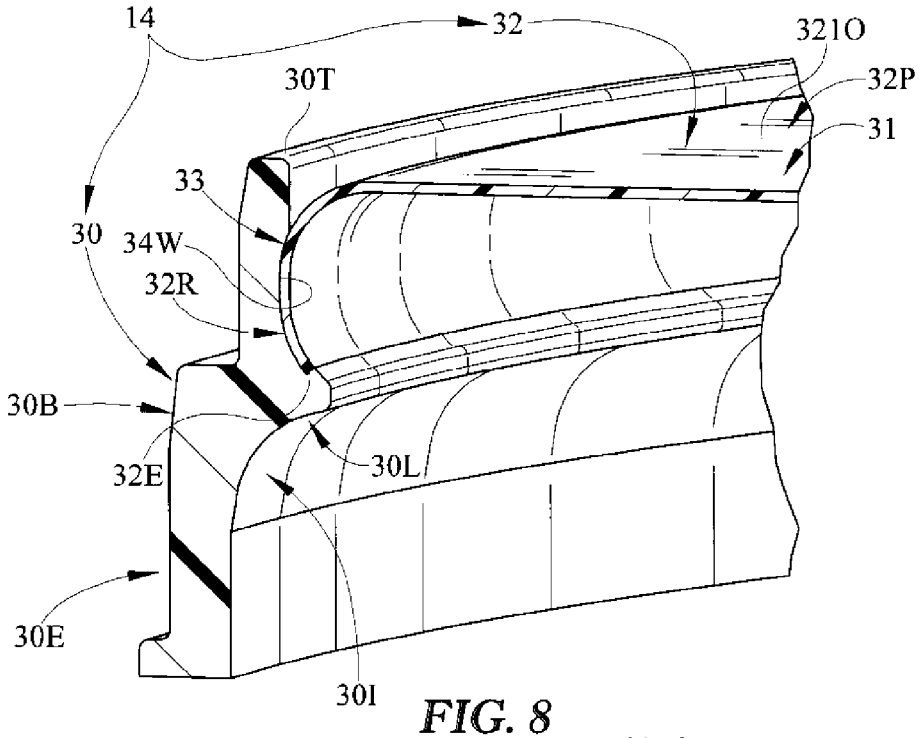
FIG. 8 is an enlarged perspective view of a section of the lid of FIGS. 1-5 taken from a first point of view.
Figure 10:
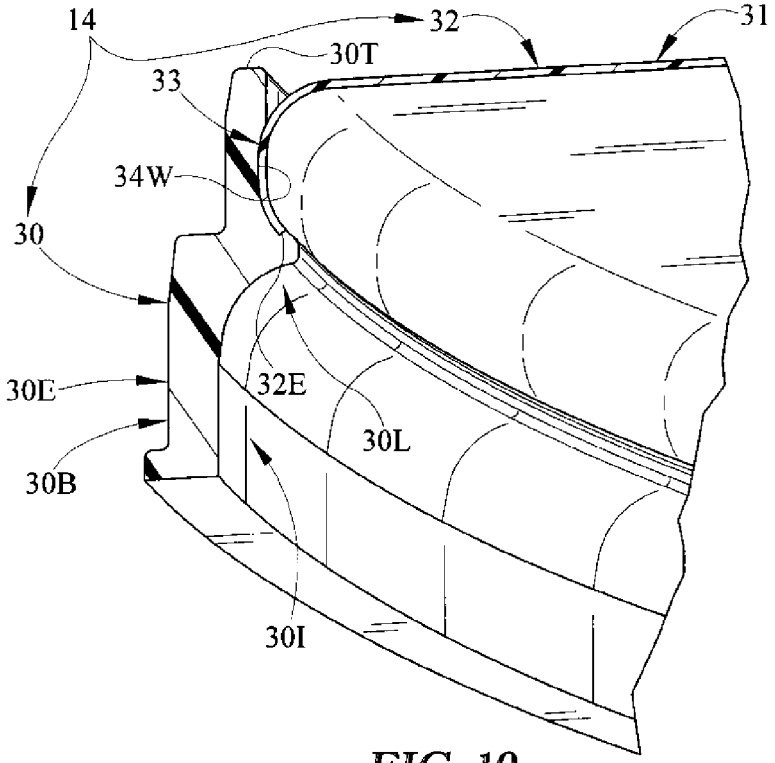
FIG. 10 is an enlarged perspective view of a section of the lid of FIGS. 1-5 taken from a second point of view.
Figure 11:
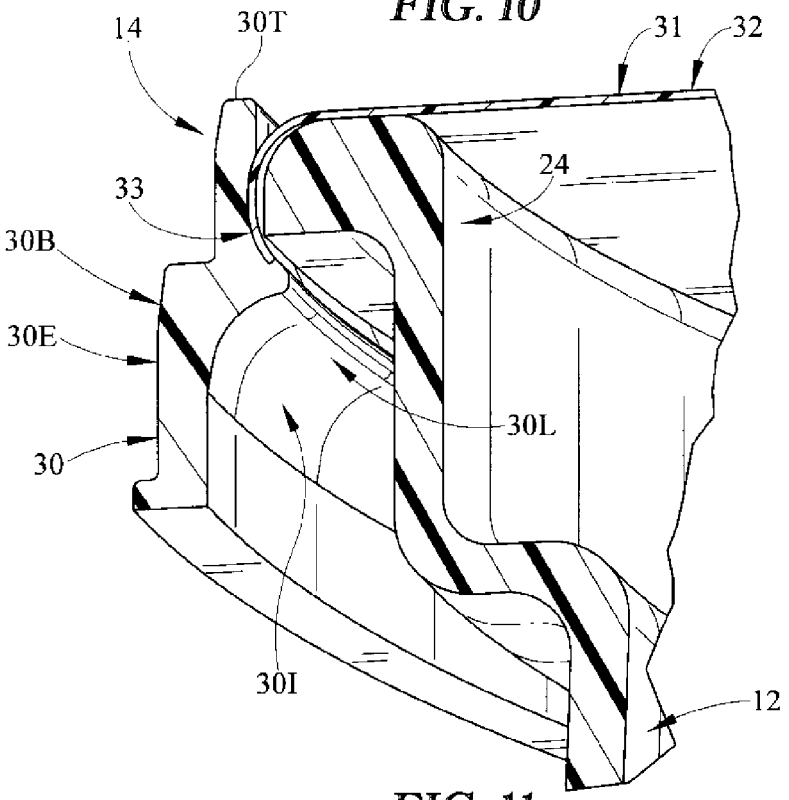
FIG. 11 is a view similar to FIG. 10 after the lid is mounted on the brim of the container.

Membrane sheet 32 has an outer surface 321O coupled permanently to sheet-support ring 30 to form lid 14 as suggested in FIGS. 4, 8, and 10. Membrane sheet 32 also includes an inner surface 323I configured to provide means for mating temporarily and repeatedly with brim 24 of container 12 to close the opening 27 into product-storage region 26 and establish a sealed connection between membrane sheet 32 and brim 24 of container 12 each time sheet-support ring 30 of lid 14 is mated with brim 24 of container 12 so that any product 25 stored in product-storage chamber 26 is retained in a sealed chamber 100 defined by container 12 and lid 14 as suggested in FIGS. 1 and 3.

Figure 7:
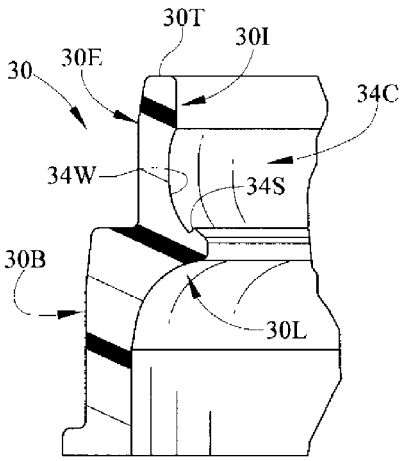
FIG. 7 is an enlarged sectional view taken along line 7-7 of FIG. 5 showing that an upper portion of the side wall and a top portion of the inwardly extending annular lid-retention lug of the sheet-support ring cooperate to define an inner perimeter surface that is arranged to mate with the outer bed (e.g., non-peelable aggressive sealant layer) of the multi-layer membrane sheet (as suggested in FIGS. 8 and 9) to retain the membrane sheet permanently in a mounted position on the sheet-support ring.
Figure 6:
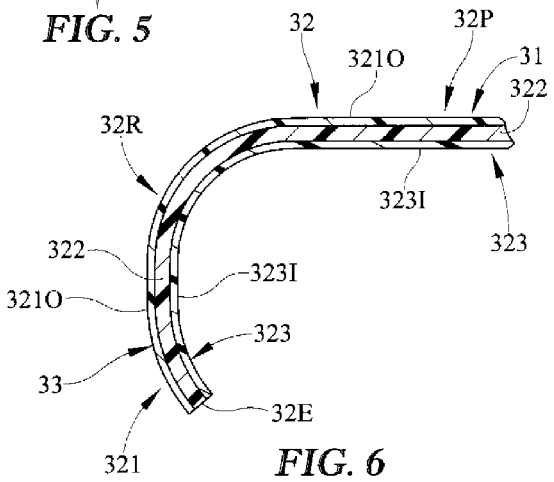
FIG. 6 is an enlarged sectional view taken along line 6-6 of FIG. 5 providing a diagrammatic cross-sectional view of the multi-layer membrane sheet included in the lid and showing that the membrane sheet comprises, in series, top to bottom, an outer bed comprising an aggressive sealant layer adapted to adhere permanently to the sheet-support ring, a core comprising a polypropylene layer, and an inner bed comprising a peelable sealant layer adapted to mate temporarily with the container brim.

Membrane sheet 32 includes a perimeter edge 32E arranged to extend between outer and inner surfaces 321O, 323I and to mate with an annular edge-support surface 34S included in sheet-support ring 30 as suggested in FIGS. 6-8. Annular edge-support surface 34S has a frustoconical shape in an illustrative embodiment as suggested in FIG. 7. Perimeter edge 32E of membrane sheet 32 is coupled permanently to annular edge-support surface 34S of sheet-support ring 30 as suggested in FIGS. 8 and 10.

Sheet-support ring 30 includes an exterior surface 30E facing away from brim 24 of container 12 and an interior surface 30I facing toward brim 24 of container 12 and lying between exterior surface 30E and brim 24 of container 12 as suggested in FIGS. 3, 4, 9, and 11. Interior surface 30I includes inwardly facing wall 34W and annular edge-support surface 34S. Inwardly facing wall 34W has a concave shape as suggested in FIG. 7.

Figure 5:
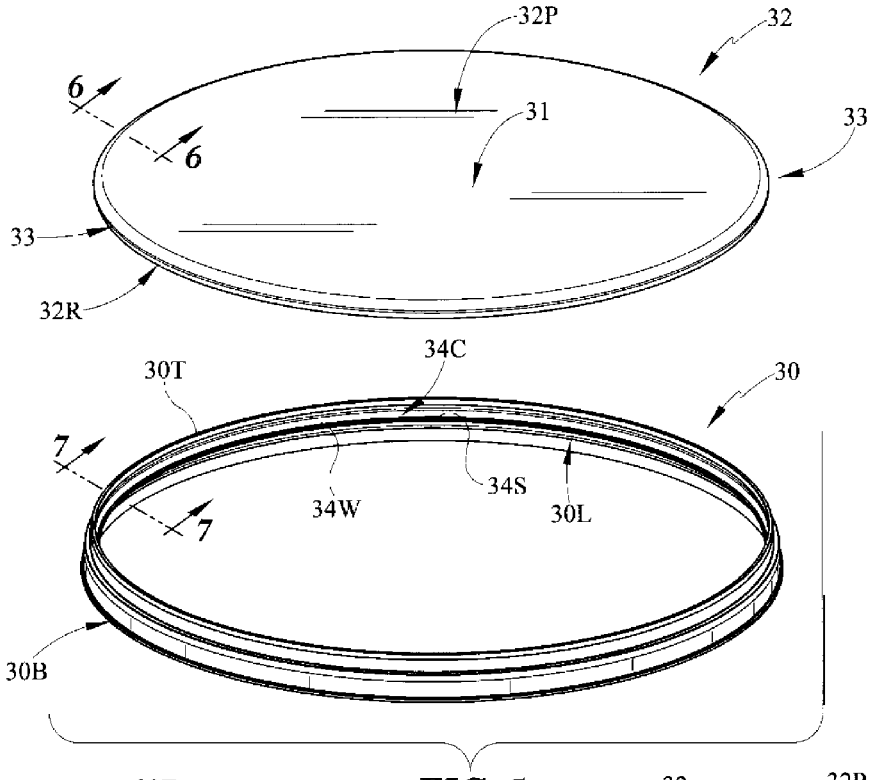
FIG. 5 is an exploded perspective assembly view of the lid of FIGS. 1-4 showing the annular sheet-support ring below the round membrane sheet.

Outer surface 321O of membrane sheet 32 includes a center portion 31 and an endless portion 33 as suggested in FIGS. 5 and 6. Center portion 31 is arranged to lie above the opening 27 into the product-storage region 26 when lid 14 is mounted on container 12 as suggested in FIGS. 4 and 8-11. Endless portion 33 is coupled to and arranged to surround center portion 31 and to terminate at perimeter edge 32E as suggested in FIG. 6. Endless portion 33 of outer surface 321O of membrane sheet 32 has a shape that is convex in cross-section and is arranged to mate with inwardly facing wall 34W of sheet-support ring 30 as suggested in FIGS. 4, 8, and 10. Center portion 31 is round and endless portion 33 is ring-shaped in an illustrative embodiment as suggested in FIG. 5. Inwardly facing wall 34W of sheet-support ring 30 has an annular and concave shape as suggested in FIGS. 5 and 7. Inwardly facing wall 34W is formed to define an annular interior channel 34C opening toward brim 24 of container 12 and receiving endless portion 33 of outer surface 321O of membrane sheet 32 therein as suggested in FIGS. 8 and 10.

Sheet-support ring 30 includes a top surface 30T arranged to lie above brim 24 of container 12 when lid 14 is mounted on container 12 as suggested in FIGS. 4 and 8-11. Outer surface 321O of center portion 31 is arranged to lie in a space provided between top surface 30T and inwardly facing wall 34W of sheet-support ring 30 as suggested in FIGS. 8 and 9.

Sheet-support ring 30 includes an annular band 30B having a top surface 30T and an annular lid-retention lug 30L appended to annular band 30B at a point below top surface 30T as suggested in FIGS. 7-9 Annular lid-retention lug 30L is arranged to lie under brim 24 of container 12 when lid 14 is mounted on container 12 to provide means for trapping a section of membrane sheet 32 between annular lid-retention lug 30L and brim 24 of container 12 to block removal of lid 14 from a mounted position on container 12 as suggested in FIGS. 4 and 9-11. Center portion 31 of outer surface 321O of membrane sheet 32 lies below top surface 30T of annular band 30B and above annular lid-retention lug 30L.

Figure 9:
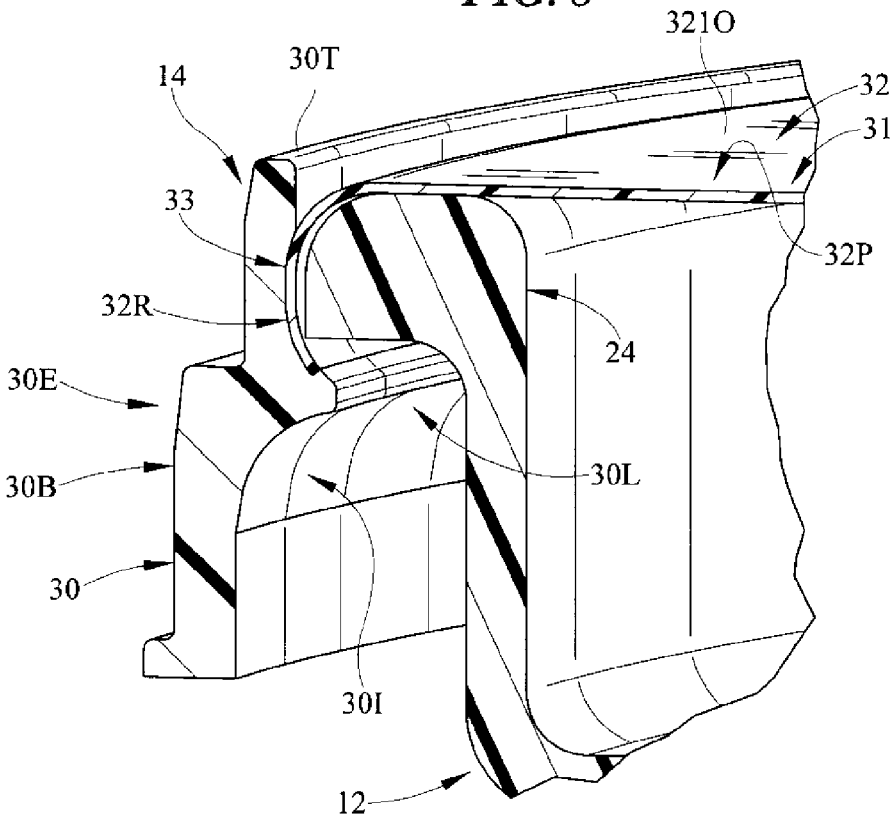
FIG. 9 is a view similar to FIG. 8 after the lid is mounted on the brim of the container showing mating engagement of a perimeter portion of the inner bed of the multi-layer membrane sheet and the outer perimeter surface of the container brim.

Annular band 30B is formed to include an inwardly facing wall 34W formed to define an annular interior channel 34C and mate permanently with outer surface 321O of membrane sheet 32 when perimeter edge 32E of membrane sheet 32 mates with annular edge-support surface 34S of sheet-support ring 30 as suggested in FIGS. 7-9. Inwardly facing wall 34W is ring-shaped and bowed about a circumference thereof in a radically outward direction away from a vertical central axis 10A passing through lid 14 and container 12. Annular edge-support surface 34S has a frustoconical shape as suggested in FIG. 7.

Membrane sheet 32 is a multi-layer component comprising an outer bed 321 providing the outer surface 321O, an inner bed 323 providing the inner surface 323I, and a core 322 interposed between and coupled to outer and inner beds 321, 323. Each of outer bed, core, and inner bed 321-323 is made of a different material in an illustrative embodiment.

Membrane sheet 32 includes a center plate 32P and an outer rim 32R as suggested in FIGS. 8 and 9. Center plate 32P is arranged to mate with brim 24 of container 12 and close the opening 27 into product-storage region 26 when lid 14 is mounted on container 12. Outer rim 32R is coupled to and arranged to extend around center plate 32P. Outer rim 32R has a curved shape. Outer surface 321O of outer bed 321 has a convex shape. Inner surface 323I of inner bed 323 has a concave shape. Center plate 32P is round and rim 32R is ring-shaped. Outer surface 321O of center plate 32P lies below top surface 30T of annular band 32B and above annular lid-retention lug 30L.

Sheet-support ring 30 may have any suitable rigid or semi-rigid character or any suitable round or non-round shape in accordance with the present disclosure. Shell-support ring 30 includes a lid-retention lug 30L or any suitable bead or engagement means for mating with container brim 24 during a capping process to mount lid 14 on container 12 and also during a repeated lid reclosure process carried out by consumers after the lid 14 is removed the first time to open the package 10. Sheet-support ring 30 also provides a structure for the consumer to push against during the lid reclosure process. Shell-support ring 30 is made of a material characterized by high-temperature stability in illustrative embodiments.

Membrane sheet 32 is a multi-layer film that is bonded to sheet-support ring 30 during an insert-molding process in an illustrative embodiment. An aggressive bond is established to mate membrane sheet 32 permanently to sheet-support ring 30.

Membrane sheet 32 is stretched tightly to mate with container brim 24 whenever lid 14 is mounted on container 12 in illustrative embodiments. Membrane sheet 32 functions to wipe container brim 24 free of contaminants during capping and lid reclosure.

Membrane sheet 32 is flexible and configured to move, deform, and conform in response to changes in pressure extant in the sealed chamber 100 formed in package 10. Membrane sheet 32 is peelable to facilitate disengagement from container brim 24 during removal of lid 14 from container 12.

Membrane sheet 32 is made of a material characterized by stiffness, high temperature stability, high puncture resistance, and high burst strength. Membrane sheet 32 provides a barrier to a fluid material such as liquid, oxygen, moisture, and solids.

It is within the scope of the present disclosure to bond membrane sheet 32 to sheet-support ring 30 during a ring-molding process (in-mold label, IML technology). Membrane sheet 32 is formable during a molding or capping process using heat and pressure.

It is within the scope of the present disclosure to configure membrane sheet 32 to provide one or more of the following tamper-evident indicators: (1) tamper evident through tactile feel of resistance while removing lid 14 from container; (2) tamper evident through discoloration due to delamination of inner be 323 providing peelable sealant layer; and (3) tamper evident through discoloration due to stretching/permanent deformation of one or more of layers 321, 322, 323.

In illustrative embodiments, multi-layer membrane sheet 32 is bonded permanently to shell-support ring 30 through material adhesion. The film comprising membrane sheet 32 is formed, for example, during an insert molding process. This encapsulates outer rim 32 R forming a smooth surface and forming a mechanical bond. Sheet-support ring 30 is higher than membrane sheet 32 as suggested in the drawings to pull membrane sheet 32 tight while capping and sealing so as to accelerate bonding of film sealing layer 323 to container brim 24 and to stretch all layers 321-323 across container brim 24.

Figure 12:
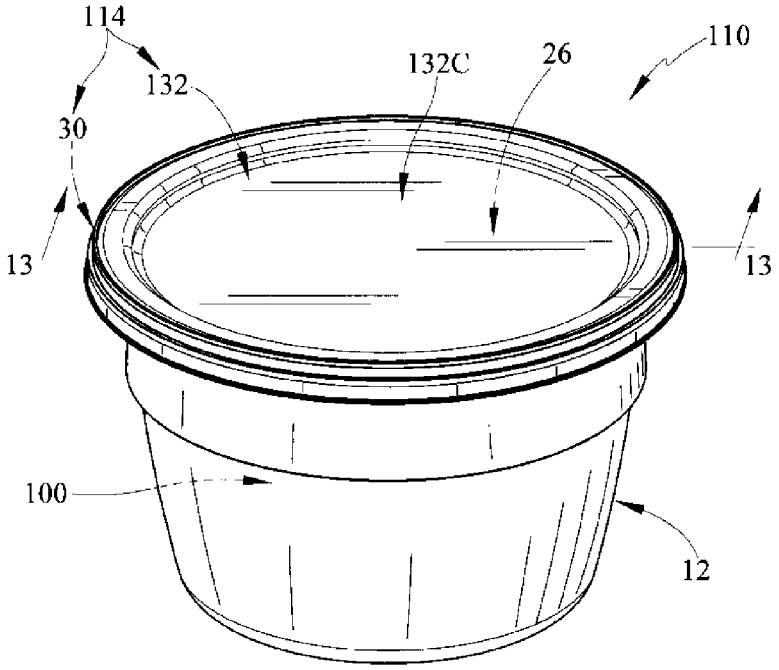
FIGS. 12-14 show a package in accordance with another embodiment of the present disclosure in which the membrane sheet is formed to include an upwardly opening concave center portion.
Figure 13:
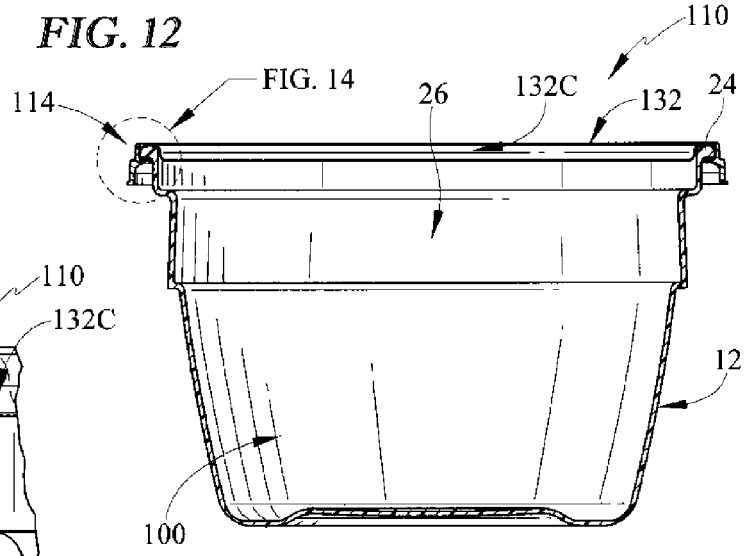
Figure 14:
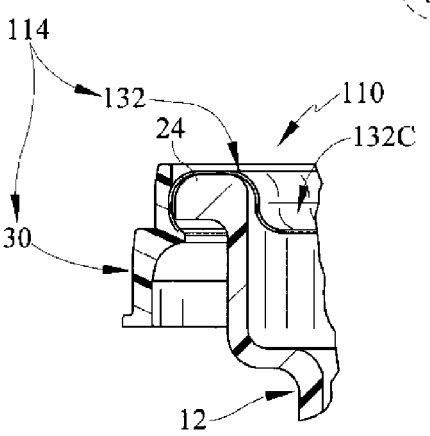

A package 110 in accordance with another embodiment of the disclosure Is illustrated in FIGS. 12-14. Package 110 includes a container 12 and a lid 114 comprising a sheet-support ring 30 and a membrane sheet 132. Membrane sheet 132 is formed to include a concave center portion 132C surrounded by container brim 24.

The invention claimed is:

1. A package comprising a container formed to include a product-storage region and a brim bordering an opening into the product-storage region and a lid adapted to mate with the brim of the container to close the opening into the product-storage region formed in the container, the lid including a sheet-support ring and a membrane sheet and wherein the sheet-support ring is configured to mate with the brim of the container when the lid is mounted on the container to extend around the opening into the product-storage region and to include an inwardly facing wall arranged to face toward the brim of the container and the membrane sheet has an outer surface bonded permanently to the sheet-support ring to form the lid and an inner surface configured to provide means for mating temporarily and repeatedly with the brim of the container to close the opening into the product-storage region and establish a sealed connection between the membrane sheet and the brim of the container lid when the sheet-support ring of the lid is mated with the brim of the container so that any product stored in the product-storage chamber is retained in a sealed chamber defined by the container and the lid, wherein the membrane sheet includes a perimeter edge arranged to extend between the outer and inner surfaces and to mate with an annular edge-support surface included in the sheet-support ring and arranged to face away from the product-storage region of the container and to be below the opening when the lid and brim are mated.

2. The package of claim 1, wherein the annular edge-support surface has a frustoconical shape.

3. A package comprising a container formed to include a product-storage region and a brim bordering an opening into the product-storage region and a lid adapted to mate with the brim of the container to close the opening into the product-storage region formed in the container, the lid including a sheet-support ring and a multi-layer membrane sheet and wherein the sheet-support ring is configured to mate with the brim of the container when the lid mounted on the container to extend around the opening into the product-storage region and to include an inwardly facing wall arranged to face toward the brim of the container and the membrane sheet has an outer surface bonded permanently to the sheet-support ring to form the lid and an inner surface configured to provide means for mating temporarily and repeatedly with the brim of the container to close the opening into the product-storage region and establish a sealed connection between the membrane sheet and the brim of the container lid when the sheet-support ring of the lid is mated with the brim of the container so that any product stored in the product-storage region is retained in a sealed chamber defined by the container and the lid, wherein the membrane sheet includes a perimeter edge arranged to extend between the outer and inner surface and to mate with an annular edge-support surface included in the sheet-support ring and wherein the perimeter edge of the membrane sheet is coupled permanently to the annular edge-support surface of the sheet-support ring.

4. The package of claim 3, wherein the sheet-support ring includes an exterior surface facing away from the brim of the container and an interior surface facing toward the brim of the container and lying between the exterior surface and the brim of the container and wherein the interior surface includes the inwardly facing wall and the annular edge-support surface.

5. The package of claim 1, wherein the inwardly facing wall has a concave shape.

6. A package comprising a container formed to include a product-storage region and a brim bordering an opening into the product-storage region, the brim having a top and a side and a lid adapted to mate with the brim of the container to close the opening into the product-storage region formed in the container, wherein the lid includes a cup-shaped membrane sheet having a substantially planar center plate and a rim coupled to and arranged to extend around a peripheral portion of the substantially planar center plate to form a single downwardly opening cavity bounded by the rim and the substantially planar center plate, wherein the lid further includes a sheet-support ring arranged to surround the brim of the container when the lid is mounted on the container and to bond permanently with an outer surface of the rim of the cup-shaped membrane sheet to place the downwardly opening cavity formed in the cup-shaped membrane sheet in communication with the product-storage region formed in the container when the lid is mated with the brim of the container, and wherein the rim of the membrane sheet further includes an inner surface configured to mate with the brim of the container to establish a sealed connection between the membrane sheet and the brim at the top and side of the brim and position the center plate to close the opening into the product-storage region and to place the peripheral portion of the center plate above and in mating relation with a confronting upwardly facing surface of the brim of the container while the sheet-support ring is mated with the brim.

7. The package of claim 6, wherein the rim of the membrane sheet is a multi-layer component comprising an outer bed providing a portion of the outer surface, an inner bed providing a potion of the inner surface, and a core interposed between and coupled to the inner and outer beds, and wherein each of the outer bed, core, and inner bed is made of a different material.

8. The package of claim 6, wherein the outer surface of the outer bed has a convex shape and the inner surface of the inner bed has a concave shape.

9. The package of claim 6, wherein the membrane sheet includes a perimeter edge arranged to extend between the outer and inner surfaces and to mate with an annular edge-support surface included in the sheet-support ring.

10. The package of claim 9, wherein the annular edge-support surface has a frustoconical shape.

11. The package of claim 9, wherein the perimeter edge of the membrane sheet is coupled permanently to the annular edge-support surface of the sheet-support ring.

12. The package of claim 11, wherein the sheet-support ring includes an exterior surface facing away from the brim of the container and an interior surface facing toward the brim of the container and lying between the exterior surface and the brim of the container and wherein the interior surface includes the inwardly facing wall and the annular edge-support surface.

13. The package of claim 12, wherein the inwardly facing wall has a concave shape.

14. The package of claim 6, wherein the sheet-support ring includes an annular band having a top surface and a bottom surface and an annular lid-retention lug appended to the annular band and arranged to extend in a radially inward direction to lie under the brim of the container when the lid is mounted on the container to provide means for trapping the rim of the membrane sheet between the annular lid-retention lug and the brim of the container to block removal of the lid from a mounted position on the container.

15. The package of claim 6, wherein the membrane sheet is a multi-layer component comprising an outer bed providing the outer surface, an inner bed providing the inner surface, and a core interposed between and coupled to the outer and inner beds and wherein each of the outer bed, core, and inner bed is made of a different material.

* * * * *